US005347945A

United States Patent [19]

McAlpine

[11] Patent Number: 5,347,945

[45] Date of Patent: Sep. 20, 1994

[54] SPINNAKER POLE CONTROL SYSTEM AND SPINNAKER POLE END THEREFOR

[76] Inventor: Peter M. McAlpine, 8 Holt Avenue, Mosman, New South Wales, 2088, Australia

[21] Appl. No.: 70,413

[22] PCT Filed: Oct. 28, 1991

[86] PCT No.: PCT/AU91/00493

§ 371 Date: Oct. 5, 1993

§ 102(e) Date: Oct. 5, 1993

[87] PCT Pub. No.: WO92/07753

PCT Pub. Date: May 14, 1992

[30] Foreign Application Priority Data

Oct. 26, 1990 [AU] Australia ..... PK3026

[51] Int. Cl.[5] ..... B63H 9/10

[52] U.S. Cl. ..... 114/89; 114/102

[58] Field of Search ..... 114/89, 90, 97, 102, 114/103, 108, 109

[56] References Cited

U.S. PATENT DOCUMENTS 3,185,121 5/1965 Nilsen .
3,207,114 9/1965 Moseley .
3,228,372 1/1966 Ridder .
5,109,786 5/1992 Hall .

FOREIGN PATENT DOCUMENTS 1205414 11/1965 Fed. Rep. of Germany .
2829043A1 1/1980 Fed. Rep. of Germany .
99494 6/1982 Japan ..... 114/103
WO88/05397 7/1988 PCT Int'l Appl. .

OTHER PUBLICATIONS

Sailing World, "Dip-Pole Jibe", pp. 36-37, Nov. 1989.
Yachting "The 12-Meter Spinnaker Jib", pp. 57-59, 96-97, Jun. 19, 1964.
Sail Power, pp. 219-226.
Sailing World, p. 8.

*Primary Examiner*—Jesus D. Sotelo
*Attorney, Agent, or Firm*—Nikaido, Marmelstein, Murray & Oram

[57] ABSTRACT

A system for controlling the spinnaker pole (10) on a sailing craft (1). The system utilizes spinnaker pole brace lines (15, 14) which extend from port and starboard side lower corners (16, 17) of the spinnaker sail (18). Both of the brace lines (15, 14) are feedably received in respective apertures in the body of the pole end (30), and remain therein regardless of whether the pole (10) is controlling the starboard or port edges of the spinnaker sail (18). The system uses a pole end (30) which is adapted to be fitted to the pole (10), and wherein the brace line apertures have rollers which minimize the resistance of the brace lines (15, 14) feeding therethrough. The body of the pole end (30) is also tapered over a portion of its length which is beyond the anchoring points of the topping lift line and the kicker line.

10 Claims, 6 Drawing Sheets

SPINNAKER POLE CONTROL SYSTEM AND SPINNAKER POLE END THEREFOR

FIELD OF THE INVENTION

The present invention relates to an improved design and operation of spinnaker pole ends for sailing craft. More specifically, the present invention relates to a spinnaker pole end which receives, in use, each of the port and starboard brace lines through respective separate apertures in the body of the spinnaker pole end so that the movement of the spinnaker pole can be controlled without requiring disconnection and reconnection of the spinnaker pole end to the respective brace lines during jibing of the sailing craft.

DESCRIPTION OF PRIOR ART

Known spinnaker pole ends comprise a single recess for releasably receiving one only of the spinnaker brace lines at any one time. That is, known pole ends comprise an open recess with a plunger biased into a position closing the recess and usually further comprise a closed "up-haul" loop and a closed "kicker" loop which are used to control the movement of the spinnaker pole during jibing manoeuvres and for trimming of the spinnaker.

In use, and specifically during a jibing manoeuvre of the craft, conventional spinnaker pole ends are necessarily disconnected from one of the spinnaker brace lines and connected to the other brace line as the pole is manoeuvred from the starboard side to the port side, or visa versa, thereby requiring a crew member to be positioned near the forestay. This operation not only requires utilisation of a crew member, but in a tactical aspect, signals to other craft that a jibing manoeuvre is imminent.

It would be advantageous to provide an improved spinnaker pole end or at least an alternative to known spinnaker pole ends to which facilitates a spinnaker pole control system obviating the need to disconnect the spinnaker pole end from one of the port or starboard brace lines, and to reconnect the spinnaker pole end to the other one of the port or starboard brace lines during a jibing manoeuvre of the sailing craft.

SUMMARY OF THE INVENTION

In one broad form the present invention provides a spinnaker pole end for use with a spinnaker sail having port and starboard spinnaker pole brace lines extending from respective lower corners thereof, the pole end comprising:

a body having an inner end adapted to be mounted an end of a spinnaker pole;

first and second anchor means for attachment to a topping lift line and a kicker line respectively, the first and second anchor means being provided on opposite sides of the body;

a first brace line aperture adapted to feedably receive one of the port or starboard brace lines of the spinner sail, and a second brace line aperture adapted to feedably receive the other one of the port or starboard brace lines of the spinnaker sail, such that the pole end is selectively slidable along both of the brace lines towards or away from the respective lower corners of the spinnaker;

wherein the first and second brace line apertures are spaced further from the inner end of the body than the first and second anchor means, and extend through the body from a top side to a bottom side thereof; and wherein the top and bottom sides of the body taper in a direction away from the inner end of the body from a position of the body proximate the anchor means.

A further broad form of the present invention provides a spinnaker pole control system for a spinnaker sail of a sailing craft, the sailing craft having a hull with an upper deck, a mast extending generally vertically upwards from a central position of the deck and a fore slay extending diagonally from an upper position of the mast to a forward central position of the sailing craft, such that the mast and the fore stay define a central plane of the sailing craft;

wherein the system comprises port and starboard brace lines extending from respective lower side corners of the spinnaker sail which is supported at an upper central corner thereof by the mast of the sailing craft;

an elongate spinnaker pole pivotally connected at an inner end thereof to the mast, with a spinnaker pole end mounted to an outer free end of the pole such that the pole has a first anchor means which is spaced from the inner end of the pole and is attached to a topping lift line which extends from a position of the mast which is at a level above the inner end of the pole for selectively lifting the outer free end of the pole relative to the sailing craft;

a second anchor means spaced from the inner end of the pole which is connected to a kicker line which extends from a position on the sailing craft at a level below the pole for pulling the outer free end of the pole downwards relative to the sailing craft;

the pole end having first and second brace line apertures with the starboard pole brace line extending from the starboard side lower corner of the sail, being fed through the first aperture of the pole end and extending to a starboard guide means on the starboard side of the sailing craft;

and the port brace line extending from the port side lower corner of the sail, being fed through the second aperture of the pole end and extending to a port guide means on the port side of the sailing craft such that the spinnaker pole end can be selectively positioned adjacent the starboard side lower corner of the sail by pulling-on and tensioning the starboard brace line whilst the part brace line is let-off, and the pole end can be selectively positioned adjacent the port side lower corner of the sail by pulling-on and tensioning the port brace line whilst the starboard brace line is let-off;

the movement of the outer end of the pole from the position adjacent the starboard side lower corner to the port side lower corner of the sail, or vice versa, being controlled by letting out the topping lift line whilst pulling-on the kicker line to move the pole end downwards and across from the starboard or port side of the centre plane whereupon the topping lift line is then pulled on and the kicker line is let out to move the pole end upwards and outwards towards the port or starboard side of the centre plane respectively.

Preferably, the pole end has roller means associated with the brace line apertures for reducing friction of the brace lines when feeding through the respective apertures.

BRIEF DESCRIPTION OF THE DRAWINGS

Preferred forms of the present invention will now be described by way of example with reference to the accompanying drawings, wherein.

PREFERRED EMBODIMENTS OF THE INVENTION

Figure 1:
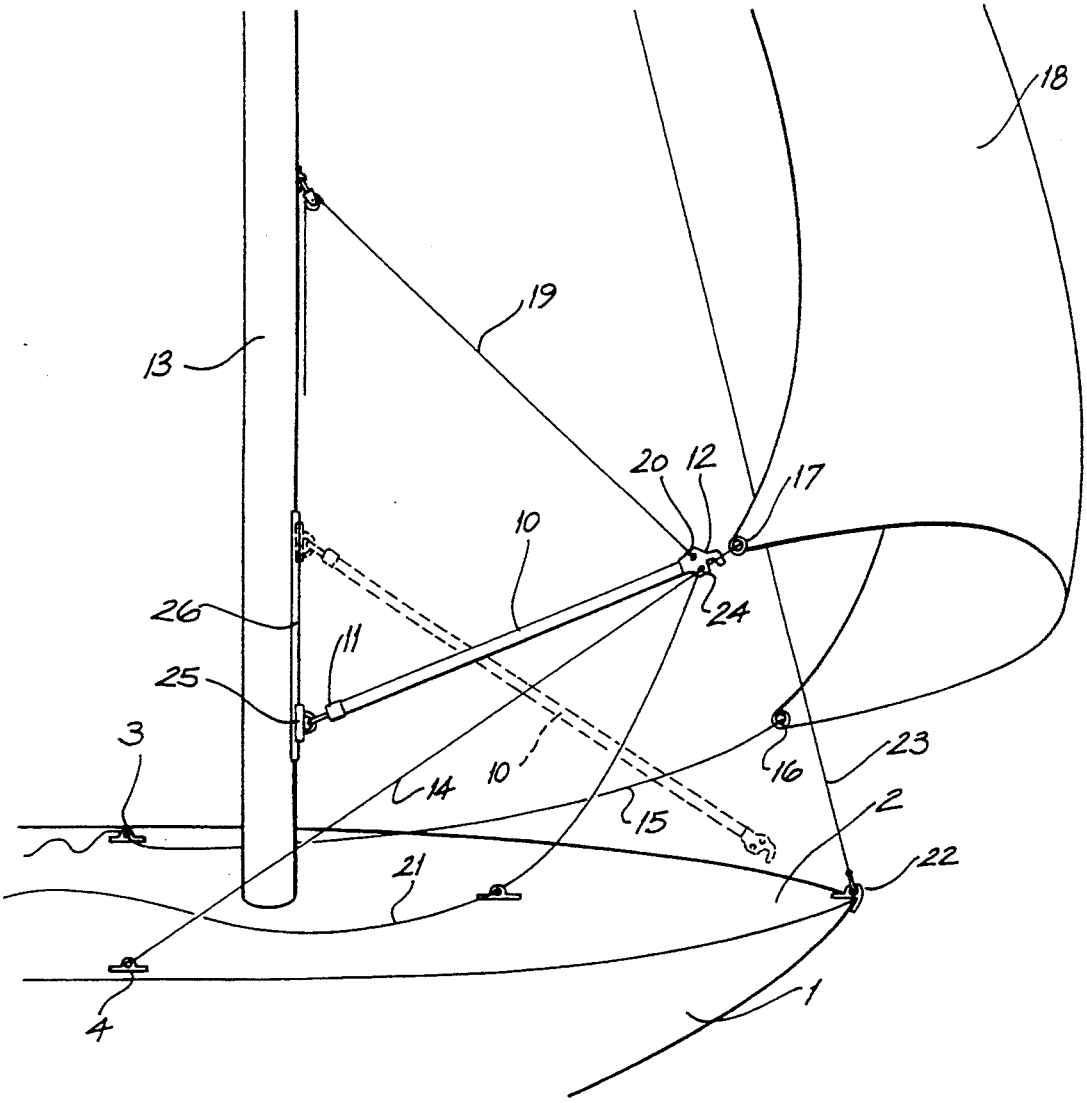
FIG. 1 PRIOR ART
FIG. 1 is a schematic perspective view of the fore-end of a sailing craft showing a typical known spinnaker rigging arrangement.

The conventional spinnaker pole and spinnaker sail rigging shown in FIG. 1 comprises the spinnaker pole 10 having an inner end 11 and an outer free end 12. The inner end 11 of the pole 10 is adapted to be connected to the mast 13 of the sailing craft 1, and the outer free pole end 12 is adapted to releasably receive and retain one of the brace lines 14, 15 of the spinnaker 18. The brace lines 14,15 extend from respective port and starboard lower corners 16, 17 of the spinnaker 18 to respective guide blocks 3,4 on opposite sides (i.e., port and starboard sides) of the upper deck 2 of the craft 1. Each of the brace lines 14,15 are typically secured to the deck 2 by a clearing arrangement and which may further comprise a winch (not shown) depending on the size of the craft 1.

Depending on the apparent wind direction with respect to the craft 1, the spinnaker pole 10 extends from the mast 13 to either the port brace line 14 or the starboard brace line 15 at a position thereof proximate the port or starboard side lower corner (i.e., clews) (16,17) respectively of the spinnaker 18. There is usually provided a donut (not shown) positioned on the brace lines 14,15 near each of the lower corners (16,17) of the spinnaker 18 and against which the outer free pole end 12 of the pole 10 is caused to bear. Generally the spinnaker pole 10 extends in a direction normal to the apparent wind direction with the outer free pole end 12 lying adjacent the bottom of the "luff" edge of the spinnaker 18.

A topping lift line 19 is connected to the up-haul loop 20 of the spinnaker pole 12 and extends to a pulley mounted either inside or on the outside of the mast 13 at a position well above the connection of the inner end 11 to the mast 13. This allows adjustment of the height of the outer free pole end 12 of the pole 10 for trimming purposes, and can be released allowing the outer free pole end 12 of the pole 10 to drop when a jibing manoeuvre is required.

A kicker line 21 extends from a position near the helm (not shown) of the craft 1 through a guide block such as a sheave or the like at a generally central position on the deck 2 between the mast 13 and the forestay 23, and then to the kicker loop 24 of the outer free pole end 12 of the pole 10.

This arrangement allows a member of the crew of the craft to guide the outer free pole end 12 to a central position under the forestay 23 whereupon another crew member positioned near the forestay then disconnects it from one brace line (14 or 15) and connects it to the other brace line (14 or 15) during a jibing manoeuvre.

Depending on the length of the spinnaker pole 10, the position of the connection of the inner end 11 of the pole 10 to the mast 13, and also on the distance between the base of the mast 13 and the position of the forestay connection 22 to the craft 1, it may be necessary for the inner end 11 of the pole 10 to be connected to a spinnaker car 25 which is slidably mounted on a vertical track 26 provided on the mast 13. This allows the inner end 11 of the pole 10 to be raised during a jibing manoeuvre to allow the distal end 12 of the pole 10 to swing down within the triangle defined by the mast 13, deck 2 and forestay 23, and without the inner end 11 of the pole 10 having to be disconnected from the mast 13.

Figure 2:
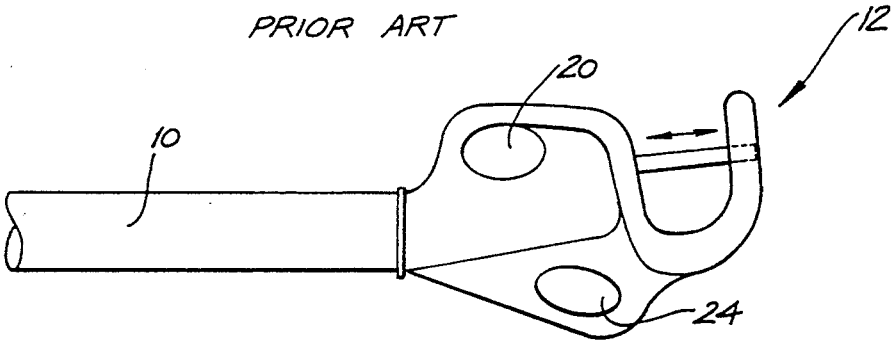
FIG. 2 PRIOR ART
FIG. 2 is a top plan view of a typical prior art spinnaker pole end.
Figure 3:
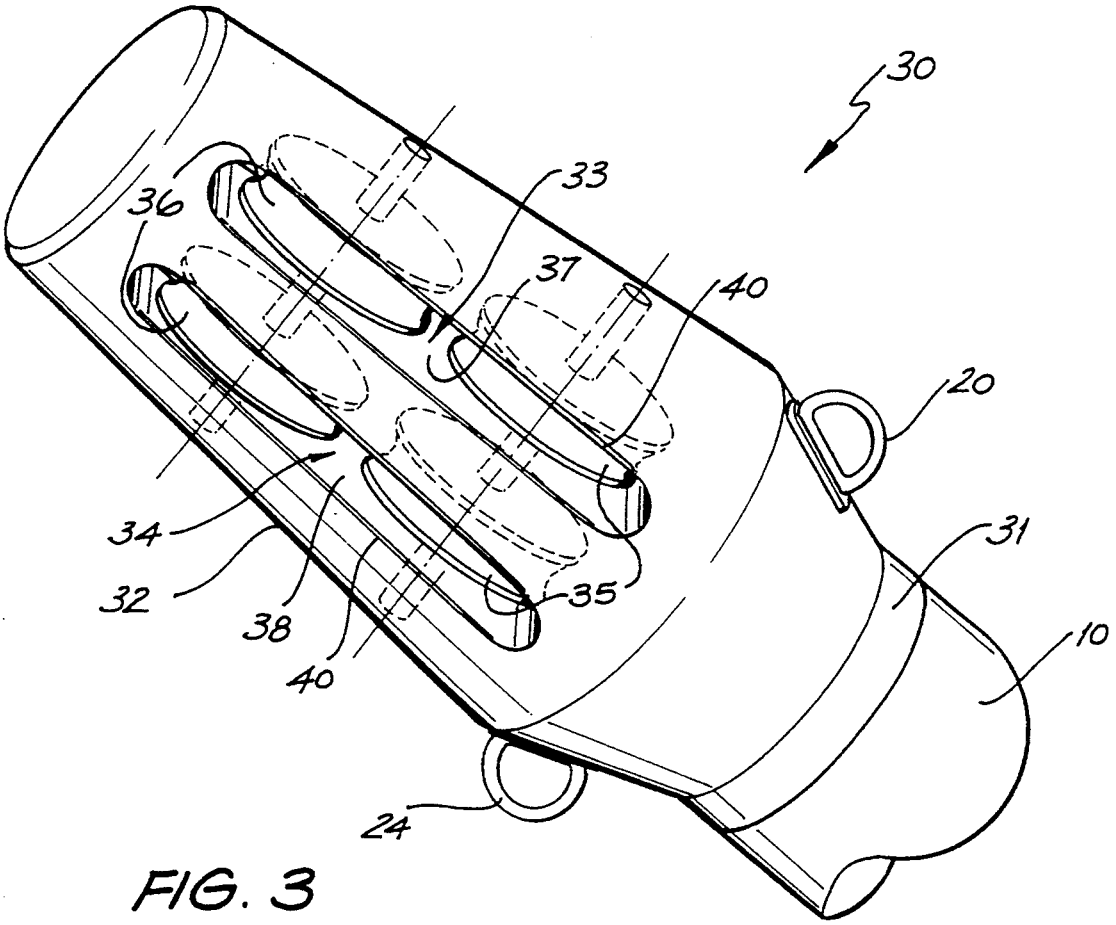
FIG. 3 is a schematic perspective view of the spinnaker pole end of the present invention.
Figure 4:
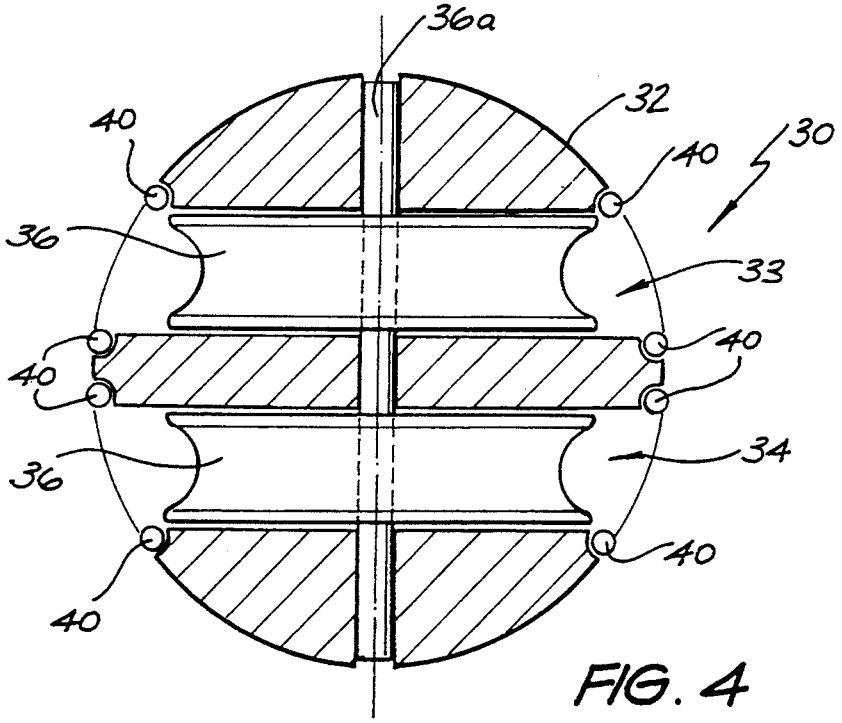
FIG. 4 is a cross-sectional view of the pole end of FIG. 3.
Figure 5:
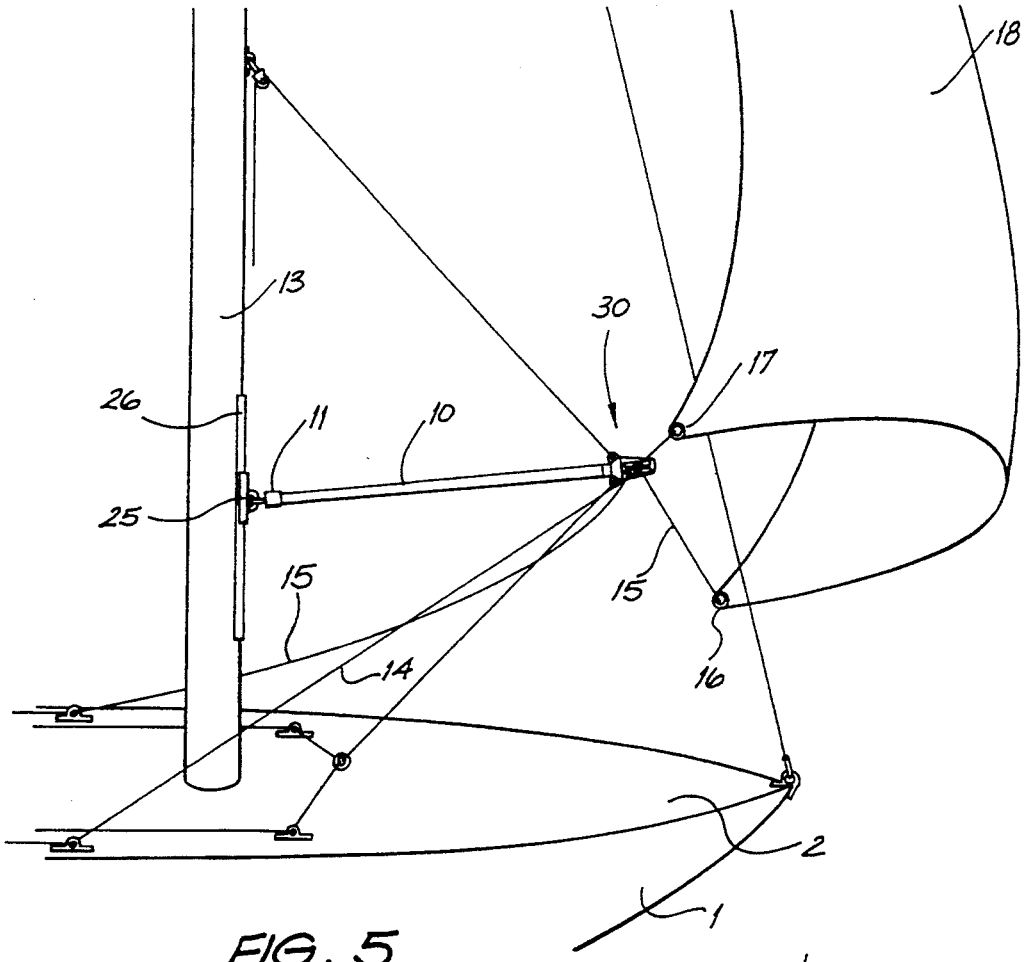
FIG. 5 is a schematic perspective view of the fore-end of a sailing craft showing a spinnaker pole rigging arrangement of the present invention.

FIGS. 3 to 5 depict a first embodiment of the spinnaker pole end 30 of the present invention which is intended to replace the pole end 12 shown in FIGS. 1 and 2. That is, the pole end 30 may be retrofitted to the otherwise standard spinnaker pole.

The spinnaker pole end 30 is generally elongate and comprises an inner mounting end 31 adapted to be mounted to the end of the spinnaker pole 10. The body 32 of the pole end 30 is tapered so as to be general conical in the direction away from the mounting end 31. Two elongate and generally parallel slots or recesses 33, 34 are provided in the body 32. Each of the recesses 33, 34 extend in the longitudinal direction of the pole end 30 and across the body to define deep slots in the body 32. In each of the recesses 33, 34 there are two spaced rollers 35, 36 which are rotatable about parallel axes **35*a*, 36*a* which extend generally normal to the plane of the recesses 33, 34. Accordingly, the recesses 33, 34, in the space between the rollers 35, 36, define through apertures 37, 38 for respectively receiving the starboard and port brace lines 15, 14**.

The inner rollers 35 are load bearing since the tension of the brace lines (14 or 15) act on the outside surface of the inner roller 35 when it is fed through the aperture 37 or 38. The outer rollers 36 are generally not load bearing but capture the brace lines (14 or 15) in the respective aperture (37 or 38). Accordingly, rollers 35 are rotatably mounted to the body 32 of the pole end 30 with sufficient load bearing capacity for the particular application. The outer rollers 36 may have a lower load bearing capacity than the inner rollers 35. The inner and outer rollers 35,36 minimise the resistance of the brace lines 14,15 to feed through the respective apertures 37,38.

The edges 40 of the recesses 33, 34 may further comprise elongate needle roller bearings 41 to reduce the friction and wear to the brace lines 14, 15 when they are feeding through the apertures 37, 38 in a jibing manoeuvre. Alternatively, the edges 40 are smoothly rounded.

The body of the pole end 30 may be conical with sufficient taper so that if either of the brace lines (14 or 15) catches and wraps around the body it will tend to slip off. Preferably the taper angle is approximately 25°.

As shown in FIG. 5, the method of rigging for the spinnaker pole of the present invention is different to that shown in FIG. 1 in that both of the spinnaker brace lines 14, 15 are fed through the respective apertures 37, 38 in the pole end 30, and which remain captured in the pole end 30 regardless of whether the starboard side edge or the port side edge of the spinnaker 18 is the luff edge, the lower corner (16 or 17) of which is supported by the pole 10 acting as a brace between the lower corner (16 or 17) and the mast 13. That is, during a jibing manoeuvre it is not necessary for the spinnaker pole brace lines 14, 15 to be swapped by disconnecting one brace line (14 or 15) from the pole end 30 and then connecting the other brace line (14 or 15). In the present arrangement, both the non-tensioned brace line which extends from the leach edge of the sail and the tensioned brace line which extends from the luff edge of the sail would extend from their respective guide blocks on the deck 2 through the respective apertures 37, 38 in the pole end 30 and to the respective lower corners or clews (16 or 17) of the spinnaker 18. Additional lengths for each of the brace lines (14,15) would be required to allow the untensioned one of the brace lines 14 or 15 to extend around what may be, in some spinnaker pole positions, a circuitous route. The additional lengths of the brace lines, however, need not be capable of withstanding high tension forces and may instead be a lighter capacity sheet spliced or otherwise suitably connected to the higher tension capacity lengths of the brace lines (14,15).

Figure 6:
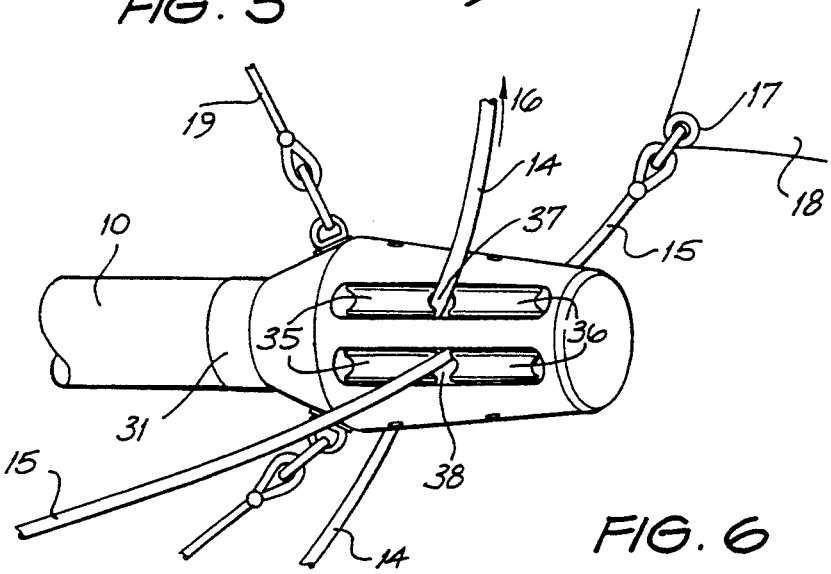
FIG. 6 is a close-up view of the pole end as seen in FIG. 5.
Figure 7:
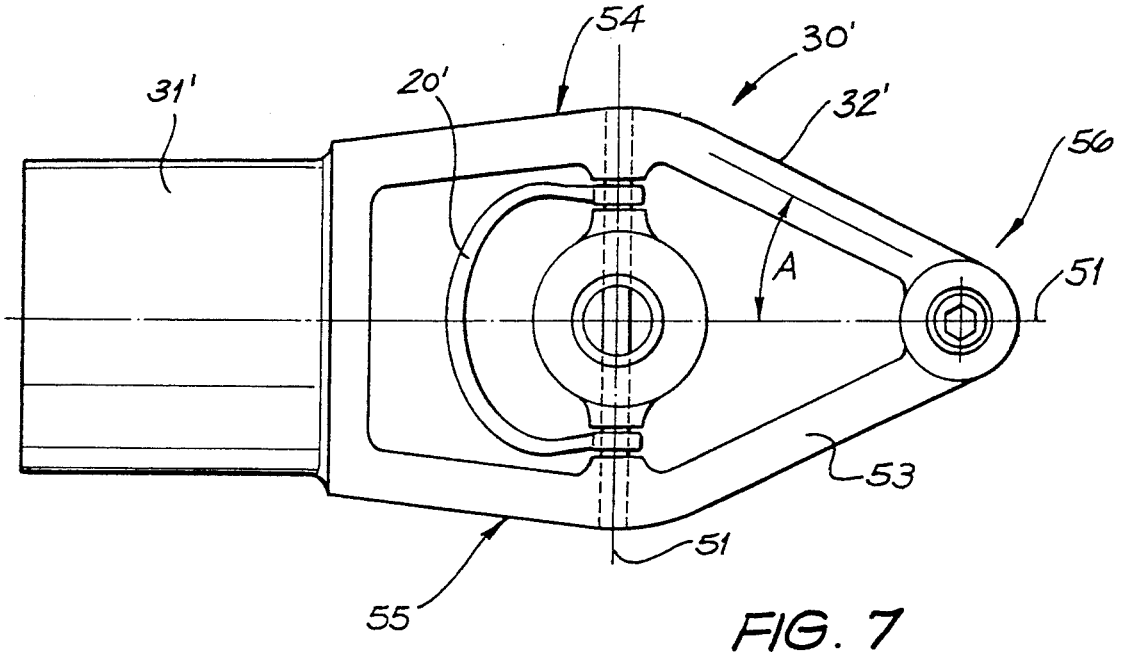
FIG. 7 is a schematic side elevational view of another embodiment of the spinnaker pole end of the present invention.
Figure 8:
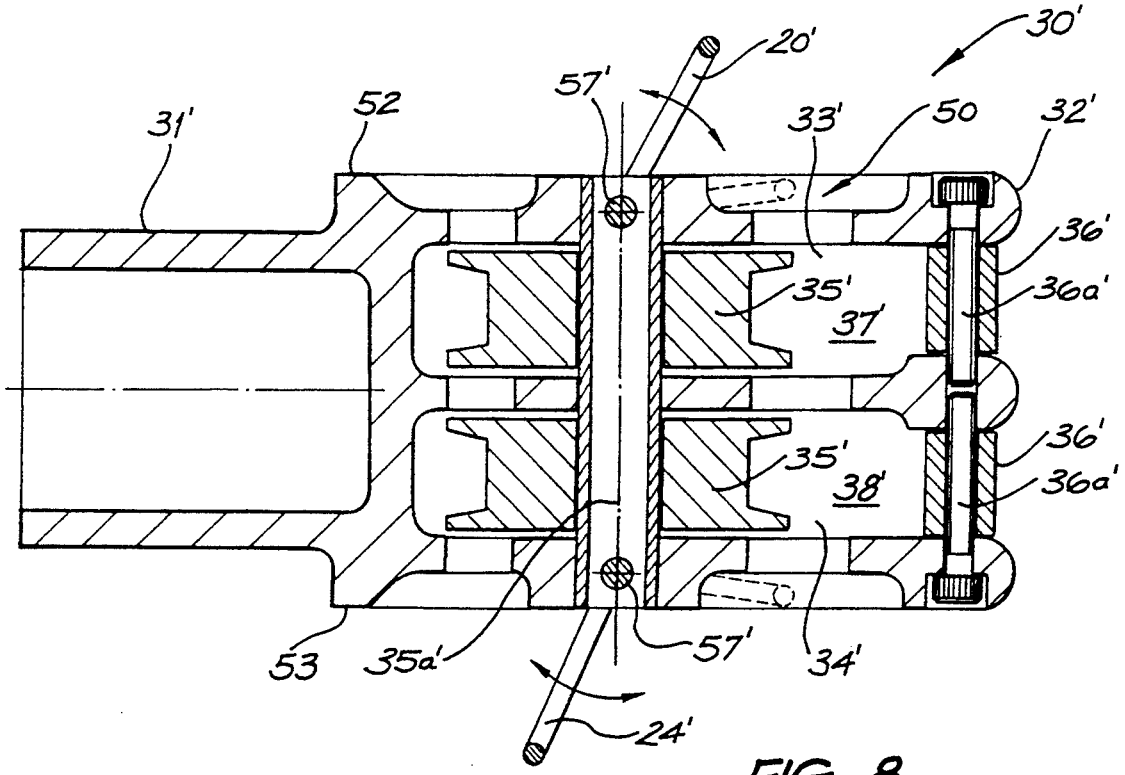
FIG. 8 is a longitudinal sectional view of the pole end of FIG. 7.
Figure 9:
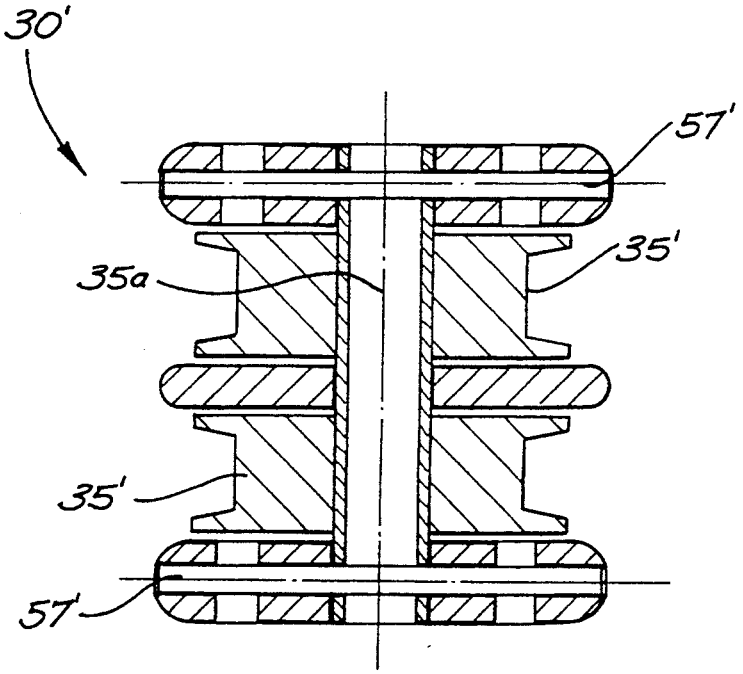
FIG. 9 is a schematic front elevational view of the pole end of FIG. 7.
Figure 10:
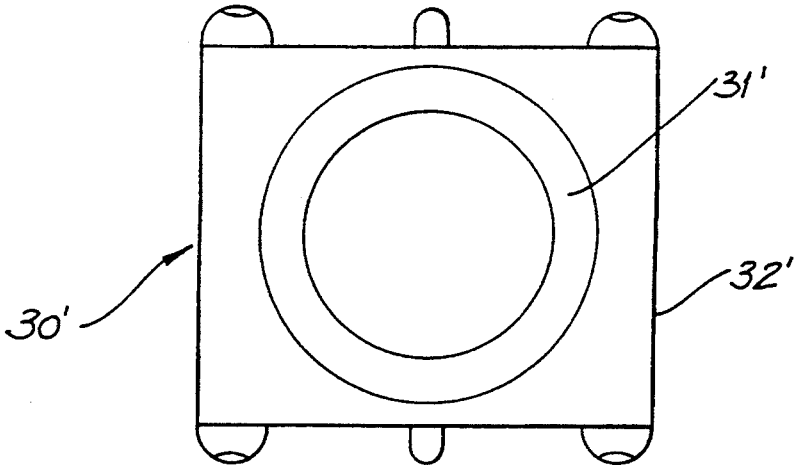
FIG. 10 is a schematic rear elevational view of the pole end of FIG. 7.
Figure 11:
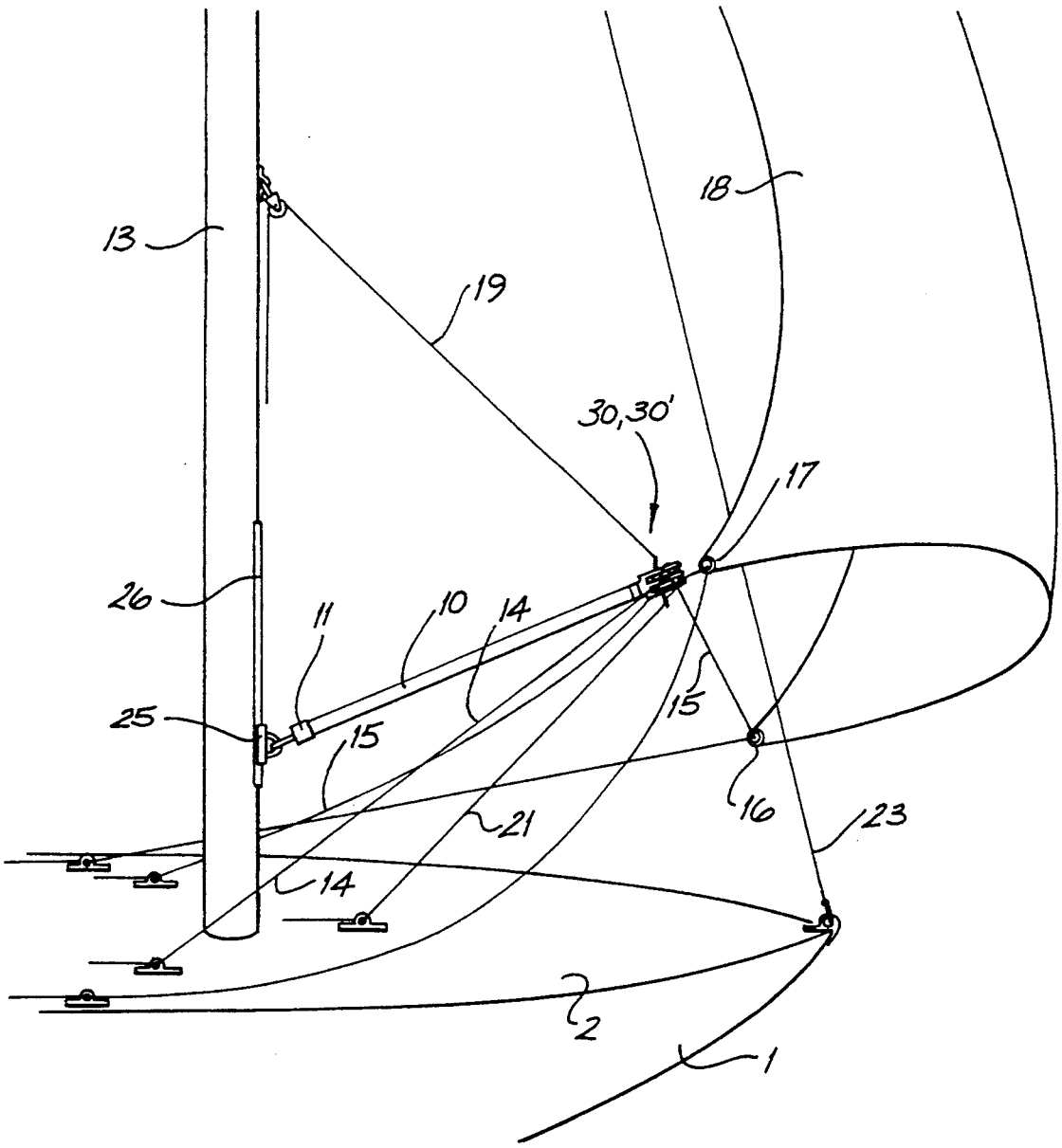
FIG. 11 is a schematic perspective view of the fore end of a sailing craft similar to FIG. 5 and additionally showing the rigging for the control of the spinnaker sail.

Another embodiment of the pole end 30' is shown in FIGS. 7–10. The body 32' has a slightly different shape to the pole end 30 shown in FIGS. 3 and 6 but is otherwise the same.

The body 32' has a plane of symmetry 51, with parallel, opposite lateral sides 52,53 of the body 32' extending generally perpendicular to the plane of symmetry 51 and top 54 and bottom 55 sides which taper towards the outer end 56 of the body 32' from a central part of the body 32', and which also taper slightly towards the inner end of the body 32' from the central part. Preferably the taper angle 'A' is approximately 25°. The central part of the body is defined by a plane wherein the distance between the top and bottom sides is at a maximum. Similar to body 32, the body 32' also has two elongate and parallel slots 33', 34' which are generally parallel to the lateral opposite sides of the body 32'. Similarly, the body 32' of the pole end 30' has a first set of inner rollers 35' rotatably mounted in a respective slot 33' or 34' and a second set of outer rollers 36' rotatably mounted in a respective slot 33' or 34' with the rotational axes of the first and second sets of rollers (35',36') being parallel and spaced a predetermined distance so that the outside circumferential surfaces of the rollers 35',36' define the inner and outer ends of the brace line apertures 37',38', with the inside surfaces of the slots 33',34' defining the sides of the apertures 37',38'. The rotational axes (**35*a*') of the first set of rollers 35' are co-linear in that an axle 57 extending through the body 32' between the lateral opposite sides rotatably supports both of the first rollers 35'. The axle lies in the plane defining the maximum distance between the top and bottom sides of the body, and also lies in the plane of symmetry of the body. The axle is retained in the body by two locating pins 57'** which extend through the body near and parallel to the lateral opposite sides thereof.

The lateral side surfaces 52,53 of the body are provided with recesses 50 such that the locating pins are partly exposed on opposite sides of the rotational axis of the first set of rollers 35'. The exposed portions of the locating pins are used to pivotally mount the anchor loops 20' and 24' which are intended to be connected to the topping lift line and the kicker line respectively. Accordingly, the anchor loops are pivotable between a retracted position adjacent and parallel to the lateral sides of the body and an extended position projecting laterally outwards from the sides of the body. The anchor loops are rounded so as not to have a distinct apex such that, in use, the topping lift line and the kicker line may slide around the loop which allows the spinnaker pole to rotate slightly to allow equalisation of forces on the pole end.

The inner end of the body 32,32' of the pole end 30,30' has a cylindrical recess adapted to receive a standard diameter pole 10. The end 30,30' may be attached using screws or a suitable adhesive (e.g., epoxy) if, for example, the pole is made of carbon.

The body of the pole end may be manufactured by casting in alloy, or even a key forming in a plastics material such as a polycarbonate. Alternatively, stainless steel or titanium may be used.

If the body is cast in alloy, it is preferably hard coat anodised to protect it from corrosion as is known in the art. The first and second pair of rollers may be of aluminium or possibly a hard plastic such as nylon.

The axles, locating pins, anchor loops and other components of the pole end are preferably manufactured from stainless steel or titanium or any other corrosion resistant material having the suitable strength characteristics.

In use, the spinnaker pole 10 can be controlled in a jibing manoeuvre by letting-off the tensioned brace line (14 or 15) and the topping lift line 19, raising the inner end 11 of the pole 10 on its track 26 (if necessary) and pulling-on the kicker line 21 to swing the pole end 30 downwards and within the space between the forestay 23, the deck 2 and the mast 3, and then letting-off the kicker line 21, lowering the inside end 11 of the pole 10 to the desired height (if necessary) and pulling-on the topping lift line 19 and the other brace line (14 or 15). This operation may be done without requiring a crew member, necessarily positioned adjacent the forestay 23, to swap the braces (14, 15) in the jibing manoeuvre. This will not only allow the crew member to be otherwise utilised, but will also provide an important tactical advantage whereby other craft in a race will not be warned of an imminent jibing manoeuvre by the crew member moving into the position adjacent the forestay 23. This would be very important in one-on-one match races such as, for example, 12 meter yacht racing.

A person skilled in the art will appreciate that since the "slack" brace line 14 or 15 is threaded through the pole end, it cannot be used to trim the leach edge of the spinnaker sail as in the conventional spinnaker set up shown in FIG. 1. Accordingly, the spinnaker for use with the present invention is provided with a second set of port and starboard control sheets extending from the port and starboard side lower corners (clews) and are threaded through conventional tweakers (not shown) and guide blocks, and to the winch/cleating arrangement (not shown) as is well known in the art.

The person skilled in the art will also appreciate that the pole, in use, should be generally perpendicular to the mast to maximise the projected length of the luff edge of the sail, and that a line extending between the port and starboard clews 16,17 should be approximately horizontal. This trimming arrangement can be achieved by adjusting the height of the inner end of the pole with respect to the mast, and by using the topping lift and kicker lines in a conventional manner.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A spinnaker pole end for use with a spinnaker sail having port and starboard spinnaker pole brace lines extending from respective lower side corners thereof, the pole end comprising:

a body having an inner end adapted to be mounted to an end of a spinnaker pole;

first and second anchor means for attachment to a topping lift line and a kicker line respectively, the first and second anchor means being provided on opposite sides of the body;

a first brace line aperture adapted to feedably receive one of the port or starboard brace lines of the spinnaker sail, and a second brace line aperture adapted to feedably receive the other one of the port or starboard brace lines of the spinnaker sail, such that the pole end is selectively slidable along both of the brace lines towards or away from the respective lower corners of the spinnaker;

wherein the first and second brace line apertures are spaced further from the inner end of the body than the first and second anchor means, and extend through the body; and wherein the body tapers in the direction away from the inner end of the body from a part thereof proximate the anchor means.

2. The pole end of claim 1 wherein the brace line apertures extend from on lateral side to the other lateral side of the body and are defined by a pair of longitudinally extending parallel spaced slots in the body extending from an outer end of the body towards the inner end and forming the sides of each aperture, with a first pair of rollers rotatably mounted within respective slots proximate an inner end of the slots so as to form inner ends of the respective apertures, and a second pair of rollers rotatably mounted proximate the outer open end of the slots so as to form the outer end of the respective apertures;

and wherein, in use, the first pair of rollers is adapted to transmit a high tension load from either one of the brace lines towards the inner end of the body.

3. The pole end of claim 2 wherein the body is generally symmetrical about a central longitudinal plane thereof with opposite lateral sides of the body extending generally normal to the plane of symmetry, with the top and bottom sides tapering towards the plane of symmetry in the direction towards the outer end of the body;

with the first pair of rollers having an outer diameter slightly smaller than the maximum distance between the top and bottom sides of the body with the rotational axis of the first pair of rollers being co-planar with the plane of maximum distance between the top and bottom sides of the body.

4. The pole end of claim 3 wherein the top and bottom sides of the body taper slightly towards the plane of symmetry in a direction towards the inner end of the body from the plane of maximum distance between the top and bottom sides of the body.

5. The pole end of claim 4 wherein side edges of the body, including edges of the slots, are smoothly rounded.

6. The pole end of claim 5 wherein the first pair of rollers each rotate about an axle which extends through the body between the lateral sides, and wherein the first and second anchoring means are loops pivotally mounted to the axle and movable between a retracted position parallel and adjacent the respective opposite lateral sides of the body, and an extended position projecting transversely outwards from the respective opposite lateral sides of the body.

7. The pole end of claim 6 wherein the loops are generally rounded so as not to have a distinct apex.

8. The pole end of claim 7 wherein the second pair of rollers have an outside diameter substantially smaller than that of the first pair of rollers, with the rotational axes of the second pair of rollers being co-linear and parallel, and spaced a predetermined distance from the axle of the first pair of rollers.

9. A spinnaker pole apparatus for use with a sailing craft, comprising:

an elongate pole;

an attachment means at one end of the pole adapted to pivotally attach the apparatus to an upright support of the sailing craft; and a spinnaker pole end as defined in claim 1 mounted to the other end of the pole.

10. A spinnaker pole control system for a spinnaker sail of a sailing craft, the sailing craft having a hull with an upper deck, a mast extending generally vertically upwards from a central position of the deck and a forestay extending diagonally from an upper position of the mast to a forward central position of the sailing craft, such that the mast and the forestay define a central plane of the sailing craft;

wherein the system comprises port and starboard brace lines extending from respective lower side corners of the spinnaker sail which is supported at an upper central corner thereof by the mast of the sailing craft;

an elongate spinnaker pole pivotally connected at an inner end to the sailing craft, with a spinnaker pole end having a body with an inner end thereof mounted to an outer free end of the pole such that the pole end has a first anchor means which is connected to a topping lift line which extends from a position of the mast which is at a level above the inner end of the pole for selectively lifting the outer free end of the pole relative to the sailing craft;

a second anchor means on the pole end which is connected to a kicker line which extends from a position on the sailing craft at a level below the pole for pulling the outer free end of the pole downwards relative to the sailing craft;

the pole end having first and second brace line apertures with the starboard pole brace line extending from the starboard lower side corner of the sail, being fed from one lateral side of the pole end through the first aperture of the pole end to the other lateral side thereof and extending directly to a starboard guide means on the starboard side of the sailing craft;

and the port brace line extending from the port side lower corner of the sail, being fed from the said other lateral side of the pole end through the second aperture of the pole end to the said one lateral side thereof and extending directly to a port guide means on the port side of the sailing craft such that the spinnaker pole end can be selectively positioned adjacent the starboard side lower corner of the sail by pulling-on and tensioning the starboard brace line whilst the port brace line is let-off, and the pole end can be selectively positioned adjacent the port side lower corner of the sail by pulling-on and tensioning the port brace line whilst the starboard brace line is let-off;

wherein the first and second brace line apertures are spaced further from the inner end of the body than the first and second anchor means, and extend through the body from one lateral side to the other lateral side thereof;

wherein the lateral sides of the body taper in the direction away from the inner end of the body from a part thereof proximate the anchor means; and wherein the movement of the outer end of the pole from the position adjacent the starboard side lower corner to the port side lower corner of the sail, or vice versa, being controlled by letting out the topping lift line whilst pulling-on the kicker line to move the pole end downwards and across from the starboard or port side of the centre plane whereupon the topping lift line is then pulled on and the kicker line is let out to move the pole end upwards and outwards towards the port or starboard side of the centre plane respectively.

* * * * *